US008628159B2

(12) United States Patent
Matsuura

(10) Patent No.: US 8,628,159 B2
(45) Date of Patent: Jan. 14, 2014

(54) METHOD FOR MANUFACTURING LIQUID EJECTING APPARATUS, LIQUID EJECTING APPARATUS, CONTROL DEVICE USED THEREFOR, AND STORAGE MEDIUM

(75) Inventor: Kazunari Matsuura, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 163 days.

(21) Appl. No.: 13/370,728

(22) Filed: Feb. 10, 2012

(65) Prior Publication Data

US 2012/0223988 A1 Sep. 6, 2012

(30) Foreign Application Priority Data

Mar. 1, 2011 (JP) ..... 2011-044255

(51) Int. Cl.
*B41J 29/38* (2006.01)
*B41J 29/393* (2006.01)

(52) U.S. Cl.
USPC ..... 347/9; 347/19

(58) Field of Classification Search
CPC ..... B41J 2/125
USPC ..... 347/9–12, 14, 15, 19; 29/25.35
See application file for complete search history.

(56) References Cited

U.S. PATENT DOCUMENTS

| | | | | |
|---|---|---|---|---|
| 7,926,153 | B2 * | 4/2011 | Tokukura | 29/25.35 |
| 8,113,635 | B2 * | 2/2012 | Yamashita et al. | 347/72 |
| 2008/0178443 | A1 | 7/2008 | Tokukura | |
| 2008/0211883 | A1 | 9/2008 | Yamashita et al. | |

FOREIGN PATENT DOCUMENTS

| | | | |
|---|---|---|---|
| JP | 2006-082046 | A | 3/2006 |
| JP | 2008-114555 | A | 5/2008 |
| JP | 2008-195047 | A | 8/2008 |

* cited by examiner

*Primary Examiner* — An Do
(74) *Attorney, Agent, or Firm* — Baker Botts L.L.P.

(57) ABSTRACT

In the manufacturing process of a printer, a check (check associated with the liquid ejecting performance of ejection outlets) on the heads is performed, and the heads are ranked based on the result of the check. The heads that are high in liquid ejecting performance are classified as a first rank; the heads that are low in liquid ejecting performance, as a second rank; and the heads that are lower in ejecting performance than the heads of the second rank, as a third rank. The heads of the third rank are dealt with as not applied to the printer. The heads of the second rank are distributed to a color inkjet head that ejects a color ink or to a pretreatment liquid ejecting head that ejects a colorless liquid. The heads of the first rank are distributed to a black inkjet head that ejects black ink.

14 Claims, 11 Drawing Sheets

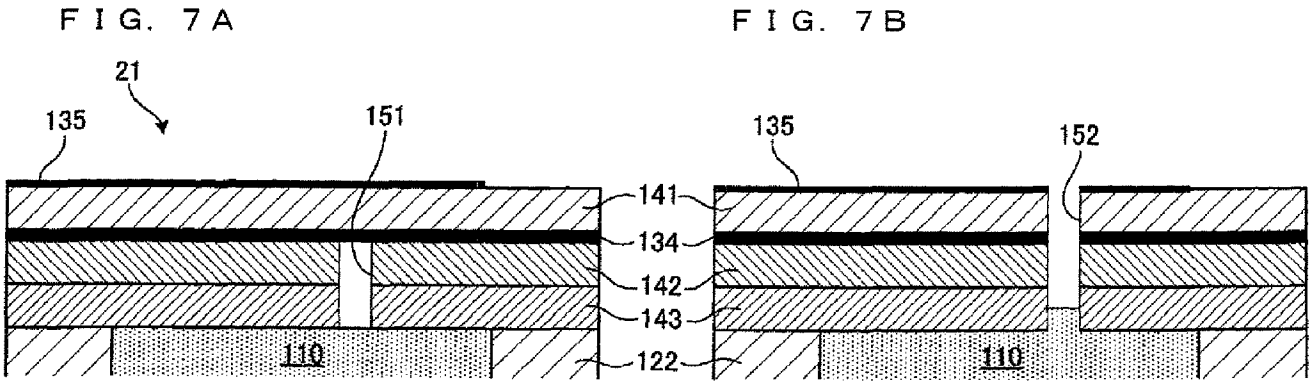
FIG. 7A
FIG. 7B
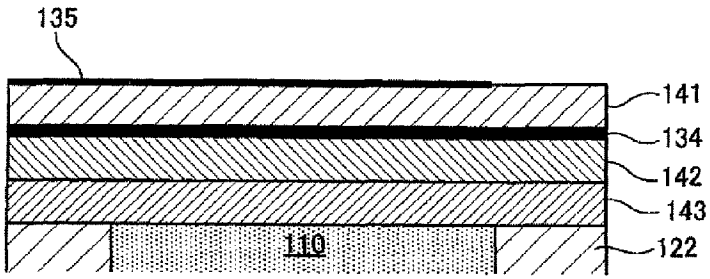
FIG. 7C

METHOD FOR MANUFACTURING LIQUID EJECTING APPARATUS, LIQUID EJECTING APPARATUS, CONTROL DEVICE USED THEREFOR, AND STORAGE MEDIUM

CROSS-REFERENCE TO RELATED APPLICATIONS

This non-provisional application claims priority under 35 U.S.C. §119(a) on Patent Application No. 2011-044255 filed in Japan on Mar. 1, 2011, the entire contents of which are hereby incorporated by reference.

TECHNICAL FIELD

The present invention relates to a method for manufacturing is a liquid ejecting apparatus that ejects a liquid such as ink, the liquid ejecting apparatus, a control device used therefor, and a storage medium.

BACKGROUND

In the liquid ejecting apparatus, there are cases where liquid ejecting performance is lower than desired performance because of manufacturing errors of flow channels of liquid ejecting heads, cracks of deformation elements, and the like. Therefore, it is considered to perform as check in the manufacturing process, for example, by a method as in Japanese Patent Application Laid-Open No. 2008-195047 and perform discarding or the like of heads the liquid ejecting performances of which are evaluated as low without applying them to the liquid ejecting apparatus.

SUMMARY

However, when a check is performed and discarding or the like is performed as described above, even though the liquid ejecting performance of each liquid ejecting head can be ensured, yield is deteriorated.

in particular, when the liquid ejecting heads are comparatively large heads such as line type heads, the yield deterioration is significant.

An object of the present invention is to provide a method for manufacturing a liquid ejecting apparatus, the liquid ejecting apparatus, a control device used therefor, and a storage device that are capable of improving yield while ensuring the overall liquid ejecting performance of the apparatus.

To achieve the above-mentioned object, according to a first aspect of the present invention, the following is provided: a method for manufacturing a liquid ejecting apparatus comprising a plurality of liquid ejecting heads where an ejection outlet that ejects a liquid and a flow channel extending to the ejection outlet are formed, respectively the plurality of liquid ejecting heads including a low brightness head that ejects a liquid of a brightness lower than a predetermined brightness and a high brightness head that ejects a liquid of a brightness equal to or higher than the predetermined brightness including a colorless liquid, the method comprising: a check process of performing a check associated with liquid ejecting performance of the ejection outlet on each of the plurality of liquid ejecting heads; a ranking process of classifying, based on a result of the check, the plurality of liquid ejecting heads as any of a plurality of ranks including a first rank where the liquid ejecting performance is equal to or higher than a predetermined performance and a second rank where the liquid ejecting performance is lower than the first rank; and a distribution process of distributing the liquid ejecting head classified as the first rank in the ranking process to the low brightness head, and distributing the liquid ejecting head classified as the second rank in the ranking process to the high brightness head.

According to a second aspect of the present invention, the following is provided: a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, wherein the high brightness head is a colorless head that ejects the colorless liquid, the colorless head and the low brightness head each include a plurality of ejection outlets, and the liquid ejecting apparatus further comprises: a detecting section that detects, of the ejection outlets of the colorless head, an ejection outlet the liquid ejecting performance of which is evaluated as lower than the predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

According to a third aspect of the present invention, the following is provided: a control device used for a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, and the high brightness head being a colorless head that ejects the colorless liquid, wherein the colorless head and the low brightness head each include a plurality of ejection outlets, and the control device comprises: a detecting section that detects, of the ejection outlets of the colorless head, an ejection outlet a liquid ejecting performance of which is evaluated as lower than a predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

According to a fourth aspect of the present invention, the following is provided: a non-transitory storage medium storing so as to be readable by a computer a program causing a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, wherein the high brightness head is a colorless head that ejects the colorless liquid, the colorless head and the low brightness head each include a plurality of ejection outlets, to function as: a detecting section that detects, of the ejection outlets of the colorless head, an ejection outlet a liquid ejecting performance of which is evaluated as lower than a predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

The lower the brightness of a liquid is, the more the liquid contributes to image quality. Therefore, the liquid ejecting head classified as the first rank is distributed to the low brightness head, and the liquid ejecting head classified as the second rank is distributed to the high brightness head without being discarded or the like. By thus distributing the heads according to the rank, yield can be improved while the overall liquid ejecting performance of the apparatus is ensured.

The above and further objects and features will more fully be apparent from the following detailed description with accompanying drawings.

BRIEF DESCRIPTION OF THE SEVERAL VIEWS OF THE DRAWINGS

FIG. 7A is a schematic sectional view showing a condition where when a lower crack is formed in the actuator unit, a check liquid is introduced into a flow channel unit in a crack check on the actuator unit;

FIG. 7B is a schematic sectional view showing a condition where when a through crack is formed, the check liquid is introduced into the flow channel unit in the crack check on the actuator unit;

FIG. 7C is a schematic sectional view showing a condition where when no crack is formed, the check liquid is introduced into the flow channel unit in the crack check on the actuator unit;

DETAILED DESCRIPTION

Hereinafter, a preferred embodiment of the present invention will be described with reference to the drawings.

First, referring to FIG. 1, the general structure of an inkjet printer 101 according to the embodiment of the liquid ejecting apparatus of the present invention will be described.

Figure 1:
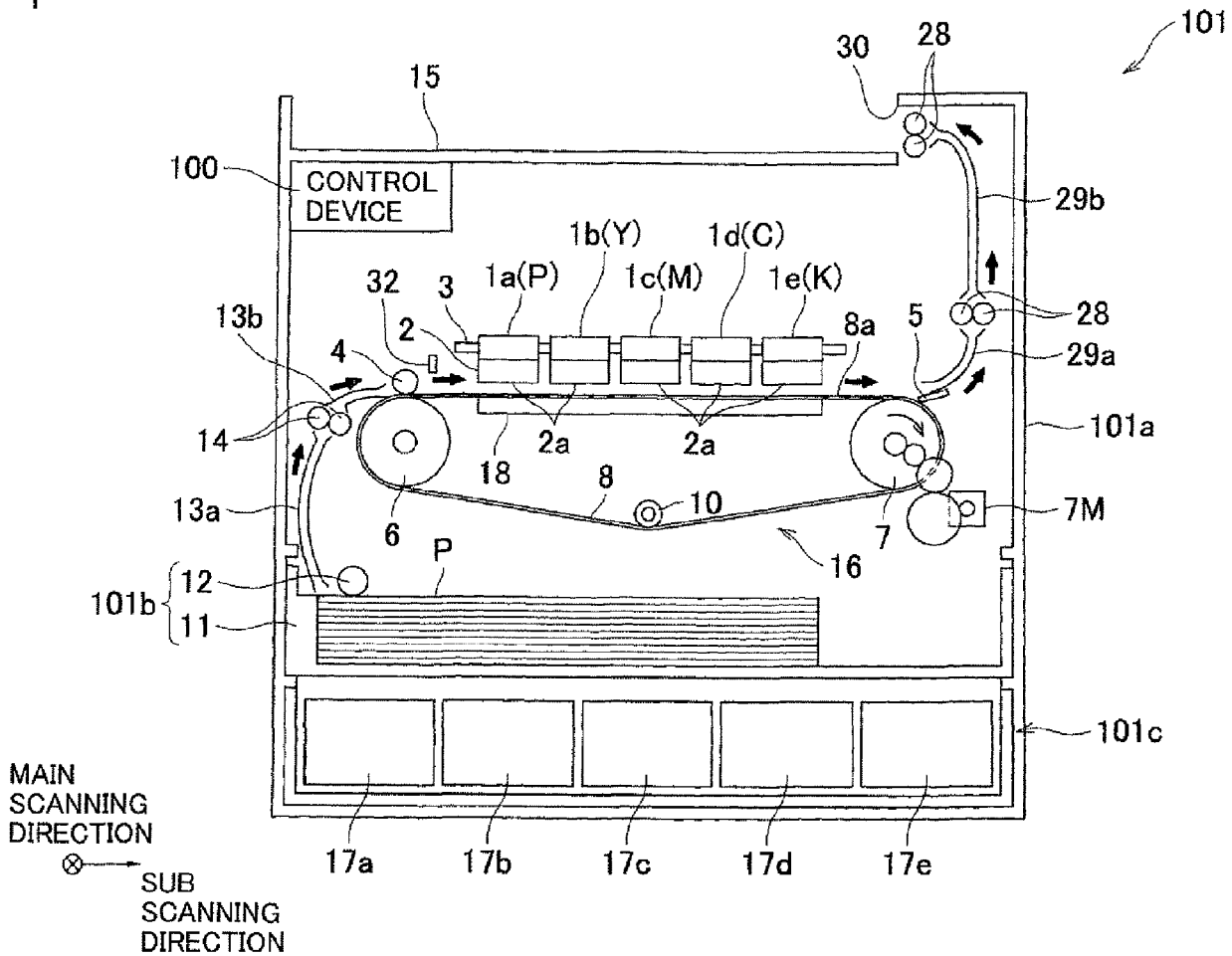
FIG. 1 is a schematic view showing the internal structure of an inkjet printer according to an embodiment of the liquid ejecting apparatus of the present invention.

The printer 101 (liquid ejecting apparatus) comprises, as shown in FIG. 1, a rectangular parallelepiped housing 101*a*. On the upper surface of the top board of the housing 101*a*, a paper discharge concave portion 15 is provided. The space inside the housing 101*a* is sectioned into an upper space, a middle space and a lower space.

In the upper space, image formation on a sheet P (recording medium) and conveyance of the sheet P to the paper discharge concave portion 15 are performed. In the middle space, accommodation and conveyance of the sheet P are performed. Between the upper space and the middle space, a sheet conveyance path from the sheet accommodation portion to the paper discharge concave portion 15 (the path along the arrow in FIG. 1) is formed. The lower space is isolated from the upper space and the middle space, and ink storage and supply are performed therein.

In the upper space, the following are disposed: five heads 1*a*, 1*b*, 1*c*, 1*d* and 1*e* (when it is unnecessary to distinguish therebetween, they will be referred to merely as head 1); a conveyance mechanism 16 that conveys the sheet P; a guide portion that guides the sheet P; and a control device 100.

The five heads 1 (liquid ejecting heads) eject liquids of colorless pretreatment liquid (P), yellow ink (Y), magenta ink (M), cyan ink (C) and black ink (B), respectively. The pretreatment liquid ejecting head 1*a* (high brightness head, colorless head) that ejects the pretreatment liquid is situated on the uppermost stream side with respect to the sheet conveyance direction. The five heads 1 have the same structure, are disposed with predetermined pitches with respect to the conveyance direction, and are fixed to a frame 3. The frame 3 is supported so as to be relatively movable with respect to the housing 101*a*.

As shown in FIG. 1, the conveyance mechanism 16 includes, in addition to belt rollers 6 and 7 and a conveyance belt 8, a nip roller 4 and a separation plate 5 that are disposed outside the conveyance belt 8 and a platen 18 and a tension roller 10 that are disposed inside the conveyance belt 8.

The conveyance belt 8 is an endless belt wound between the rollers 6 and 7, and receives downward tension by the tension roller 10. The platen 18 is a flat plate disposed so as to face the five heads 1, and supports the upper loop of the conveyance belt 8 from inside. The belt roller 7 is a driving roller which is turned by the turning force of a conveyance motor 7M. The turning force is transmitted through a plurality of gears. The belt roller turns in the clockwise direction in FIG. 1, whereas the conveyance belt 8 runs in the direction of the arrow. The belt roller 6 is a driven roller which is turned by the conveyance belt 8 running. The nip roller 4 is disposed so as to face the belt roller 6, and presses the sheet P against the conveyance belt 8. On the outer peripheral surface of the conveyance belt 8, a weakly sticky silicone layer is formed, and the sheet P is held on the outer peripheral surface. The separation plate 5 is disposed so as to face the belt roller 7, separates the sheet P from the conveyance belt 8, and guides it to the succeeding guide portion.

The guide portion is constituted by an upstream side guide portion and a downstream side guide portion with respect to the conveyance direction. The upstream side guide portion and the downstream side guide portion sandwich the conveyance mechanism 16 from both sides with respect to the conveyance direction. The upstream side guide portion has guides 13*a* and 13*b* and a pair of feed rollers 14 to be turned by the turning force of a feed motor 14M, and connects a paper feed unit 101*b* and the conveyance mechanism 16. The sheet P for image formation is conveyed toward the conveyance mechanism 16. The downstream guide has guides 29*a* and 29*b* and two pairs of feed rollers 28, and connects the conveyance mechanism 16 and the paper discharge concave portion 15. The sheet P having undergone image formation is conveyed toward the paper discharge concave portion 15.

In the upper space, on the lower surface of the top board of the housing 101*a*, the control device 100 (a detecting section, a first controller, a second controller, a third controller) is disposed. The control device 100 controls the operation of the entire printer 101. The control device 100 controls the taking out, conveyance and discharge of the sheet P and a liquid ejecting operation synchronized with the conveyance based on a print instruction, received from an external apparatus. When the sheet P is brought out from the paper feed unit 101*b* and passes below the five heads 1, the pretreatment liquid and inks are successively ejected from the heads 1 to form an image on the sheet P. The ejecting from the heads 1 is performed based on a sheet front end detection signal from a sheet sensor 32. The sheet sensor 32 is situated on the upstream side, in the conveyance direction, of the pretreatment liquid ejecting head 1*a*. Further, the sheet P is discharged onto the paper discharge concave portion 15 from a discharge outlet 30.

In the middle space, the paper feed unit 101*b* is disposed. The paper feed unit 101*b* has a paper feed tray 11 and a paper feed roller 12. The paper feed tray 11 which is detachably attachable to the housing 101*a* is a box that opens upward. The paper feed tray 11 accommodates a plurality of sheets P, and the paper feed roller 12 is turned by the turning force of a paper feed motor 12M and takes out the uppermost sheet. P.

In the lower space, a tank unit 101*c* is disposed. The tank unit 101*c* is detachably attachable to the housing 101*a*, and five tanks 17*a*, 17*b*, 17*c*, 17*d* and 17*e* (when it is unnecessary to distinguish therebetween, they will be referred to merely as tank 17) are disposed therein. The tank 17*a* contains the pretreatment liquid. The tanks 17*b*, 17*c*, 17*d* and 17*e* contain yellow ink, magenta ink, cyan ink and black ink, respectively. The tanks 17 are connected to the corresponding heads 1 through tubes (not shown).

The pretreatment liquid is, for example, a colorless liquid having the property of improving density (the property of improving the density of the ink impinging on the sheet P), the property of preventing bleeding and striking through of the ink (a phenomenon in which the ink impinging on the sheet P passes through the layer of the sheet P to bleed onto the rear surface), the property of improving the color development performance and quick-drying performance of the ink, and the property of preventing wrinkles and curls of the sheet P after the impingement of the ink. The material of the pretreatment liquid may be selected as appropriate such as a liquid containing a multivalent metal salt such as polymer cation or magnesium salt. The pretreatment liquid ejected from the pretreatment liquid ejecting head 1*a* impinges on the sheet P earlier than the inks ejected from the inkjet heads 1*b* to 1*e*.

Next, referring to FIGS. 1, 2, 3, 4, 5A and 5B, the heads 1 will be described.

Figure 3:
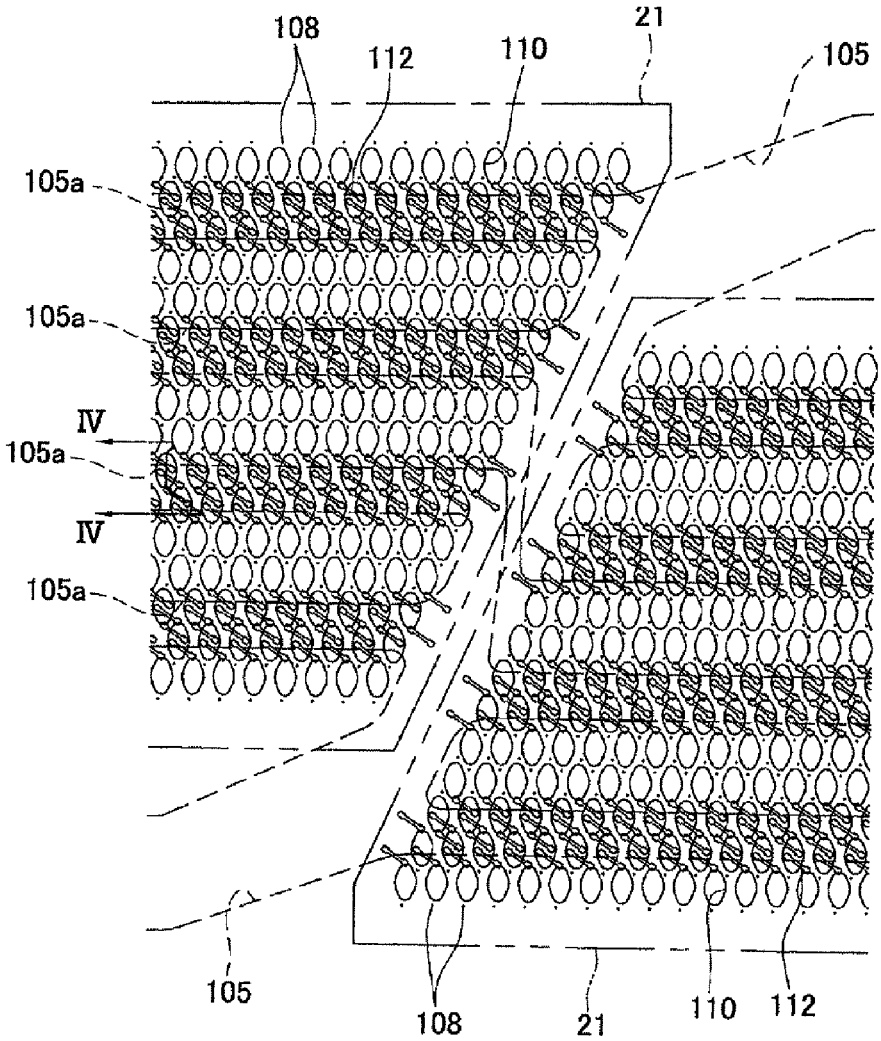
FIG. 3 is an enlarged view of a region III surrounded by the chain line in FIG. 2.

For convenience of explanation, in FIG. 3, actuator units 21 to be drawn with solid lines are drawn with chain double-dashed lines, and apertures 112 to be drawn with broken lines are drawn with solid lines.

Figure 2:
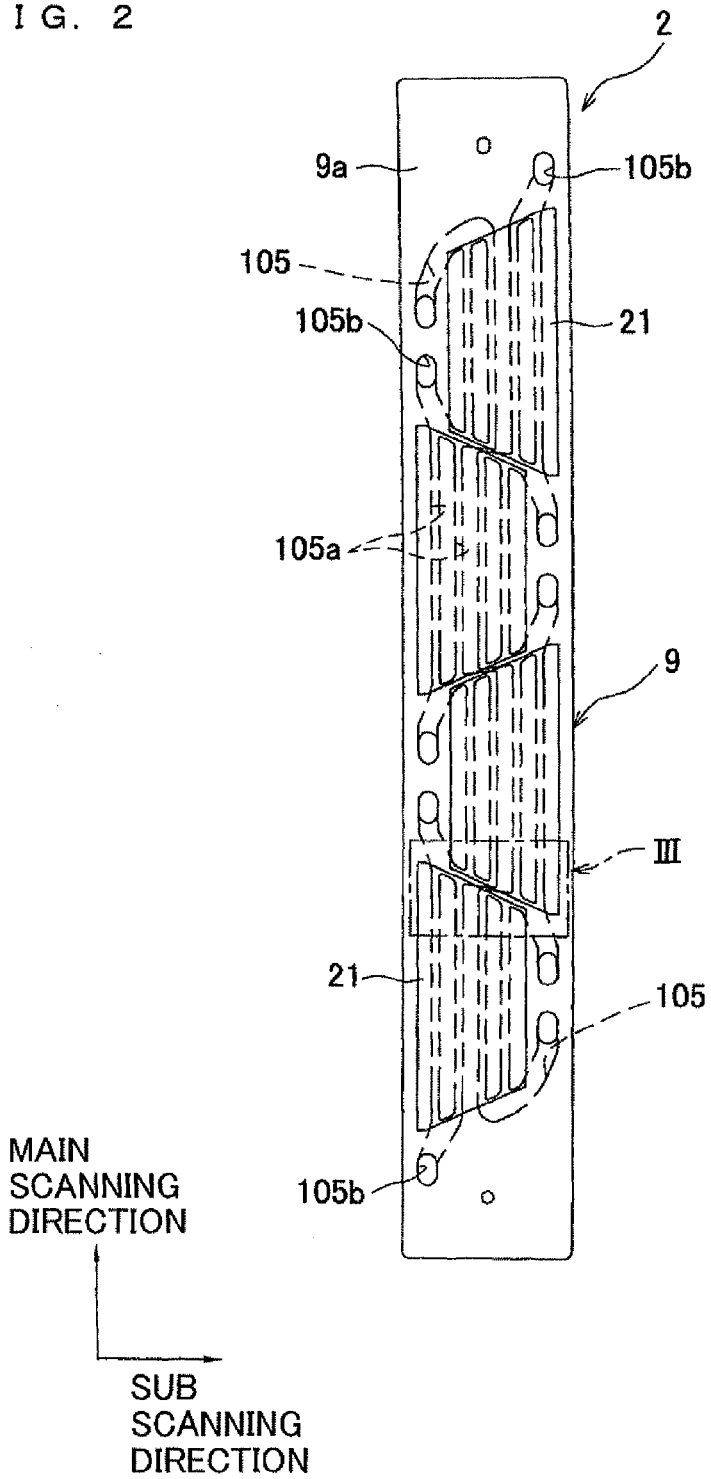
FIG. 2 is a plan view of a head main unit included in the printer.

The heads 1 are, as shown in FIG. 2, line type heads elongated in a main scanning direction (direction orthogonal to the conveyance direction), and are each a lamination of a head main unit 2, a liquid distribution member, a circuit board and the like. The liquid distribution member equally distributes the liquid supplied from the tanks 17, to the head main unit 2. The circuit board adjusts the control signal from the control device 100, and supplies it to the actuator units 21. The actuator units 21 and the circuit board are electrically connected together by a COF (chip on film) mounted with a driver IC.

The head main unit 2 includes, as shown in FIG. 2, a flow channel unit 9 and four actuator units 21 (deformation elements) fixed to an upper surface 9*a* of the flow channel unit 9.

Figure 4:
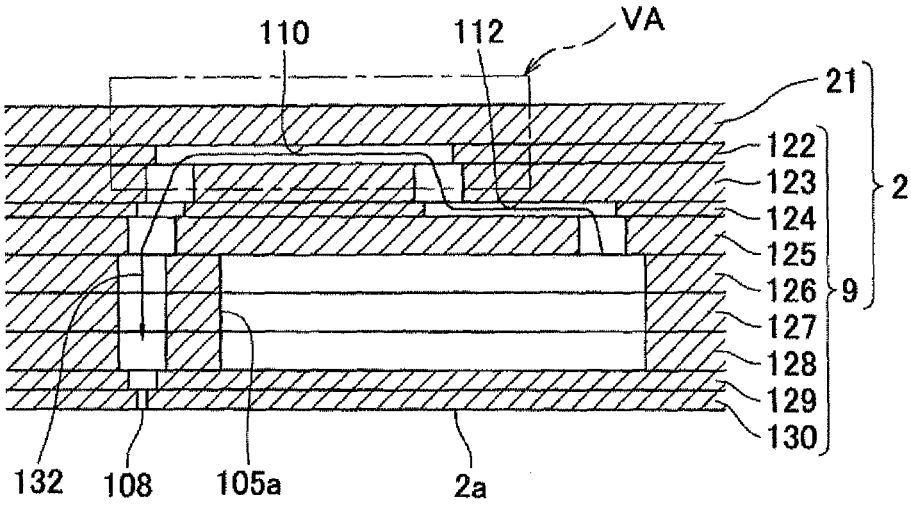
FIG. 4 is a partially sectional view taken along the line IV-IV of FIG. 3.

The flow channel unit 9 is, as shown in FIG. 4, a conductive lamination of nine stainless steel plates 122, 123, 124, 125, 126, 127, 128, 129 and 130.

On the upper surface 9*a* of the flow channel unit 9, as shown in FIGS. 2 and 3, a plurality of pressure chambers 110 and ten supply inlets 105*b* are formed so as to open. Into each supply inlet. 105*b*, the liquid supplied from the above-described liquid distribution member flows. Inside the flow channel unit 9, as shown in FIGS. 2 to 4, the following are formed: a manifold flow channel 105 connected to the supply inlets 105*b*; a plurality of sub manifold flow channels 105*a* branching off from the manifold flow channel 105; and a plurality of individual flow channels 132 (flow channels) extending from the outlets of the sub manifold flow channels 105*a* to ejection outlets 108 through the pressure chambers 110. The pressure chambers 110 are, as shown in FIG. 3, connected to the sub manifold flow channels 105*a* through the apertures 112. The lower surface of the flow channel unit 9 is an ejection surface 2*a* that ejects the liquid. On the ejection surface 2*a*, a plurality of ejection outlets 108 are evenly spaced in the main scanning direction.

The actuator units 21 have, as shown in FIG. 2, trapezoidal planar shapes. The four actuator units 21 are arranged in two lines in a staggered pattern in the main scanning direction. The oblique sides of the adjoining actuator units 21 overlap each other with respect to a sub scanning direction (direction orthogonal to the main scanning direction). The actuators 21 are disposed so that the lower base of the trapezoid is outside in the sub scanning direction.

Figure 5A:
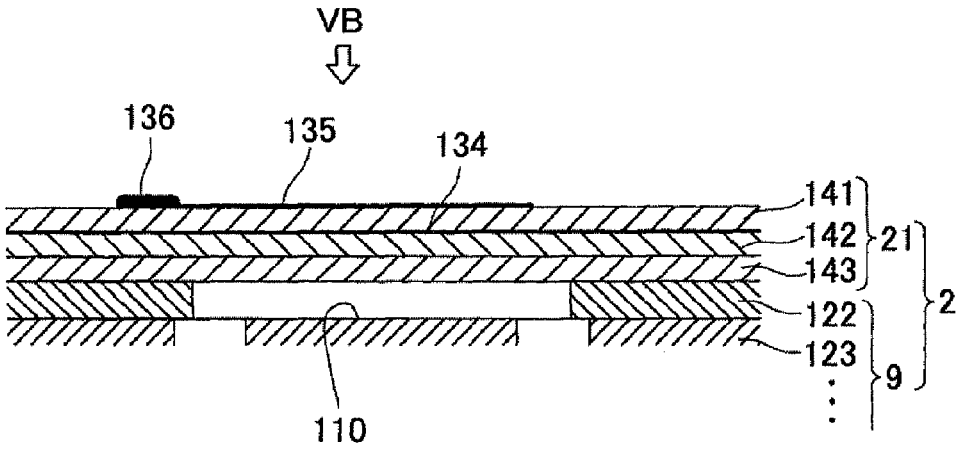
FIG. 5A is an enlarged sectional view of a region VA surrounded by the chain line in FIG. 4.
Figure 5B:
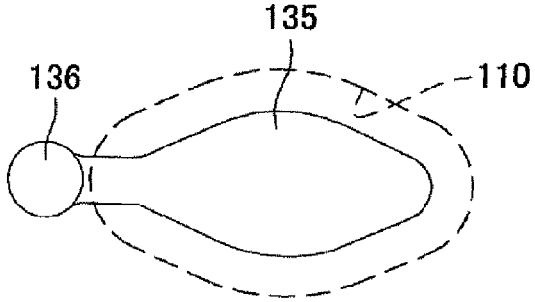
FIG. 5B is a partial plan view of an actuator unit viewed from the direction of the arrow VB in FIG. 5A.

The actuator units 21 are made of a ceramics material of lead zirconate titanate (PZT) having ferroelectricity, and as shown in FIG. 5A, include three piezoelectric layers 141, 142 and 143. The piezoelectric layers 141 to 143 have the same shape and size, and is define the outer shape of the actuator units 21. Only the piezoelectric layer 141 has an electrode formed on both of the upper and lower surfaces. An individual electrode 135 has, as shown in FIG. 5B, a substantially lozenge-shaped planar shape similar to the pressure chamber 110. A main part of the individual electrode 135 faces the pressure chamber 110, and one acute angle part of the lozenge extends outside the pressure chamber 110. At the end in the direction of extension, a land 136 that is circular in a plan view is formed. A common electrode 134 is sandwiched between the two piezoelectric layers 141 and 142, and is formed substantially on the entire surface of the lower surface of the piezoelectric layer 141 (the upper surface of the piezoelectric layer 142). The piezoelectric layer 143 has its lower surface fixed to the upper surface 9*a* of the flow channel unit 9, and seals the opening of the pressure chamber 110. On the upper surface of the piezoelectric layer 141, a land for the common electrode (not shown) electrically connected to the common electrode 134 is also formed. To the land 136 for the individual electrode, a driving signal is selectively supplied, and to the land for the common electrode, a grand potential as the reference potential is supplied.

Only the piezoelectric layer 141 is polarized, and functions as an active layer. In the part of the piezoelectric layer 141 that is sandwiched between the individual electrode 135 and the common electrode 134, when an electric field in the direction of polarization is applied, a piezoelectric strain in the surface direction (displacement in the vibration mode of d31) is caused. On the other hand, no spontaneous displacement occurs in the piezoelectric layers 142 and 143. At this time, a strain difference occurs in the surface direction between the piezoelectric layer 141 and the piezoelectric layers 142 and 143, whereby the parts of the piezoelectric layers 141 to 143 that are sandwiched between the individual electrode 135 and the pressure chamber 110 are deformed (unimorph-deformed) in a direction orthogonal to the surface direction to change the volumetric capacity of the pressure chamber 110.

That is, the part in the actuator unit 21 that is sandwiched between the individual electrode 135 and the pressure chamber 110 acts as a piezoelectric actuator that provides the liquid in the pressure chamber 110 with energy for ejection from the ejection outlet 108. In the actuator unit 21, piezoelectric actuators as many as the pressure chambers 110 are formed. The piezoelectric actuators are capable of being deformed independently of one another.

In the present embodiment, when a drive signal is supplied from the driver IC to the individual electrode 135, the piezoelectric actuator is deformed so as to be convex toward the pressure chamber 110 to reduce the volumetric capacity of the pressure chamber 110. Thereby, pressure (ejection energy) is applied to the liquid in the pressure chamber 110, so that the liquid is ejected from the ejection outlet 108.

Figure 6:
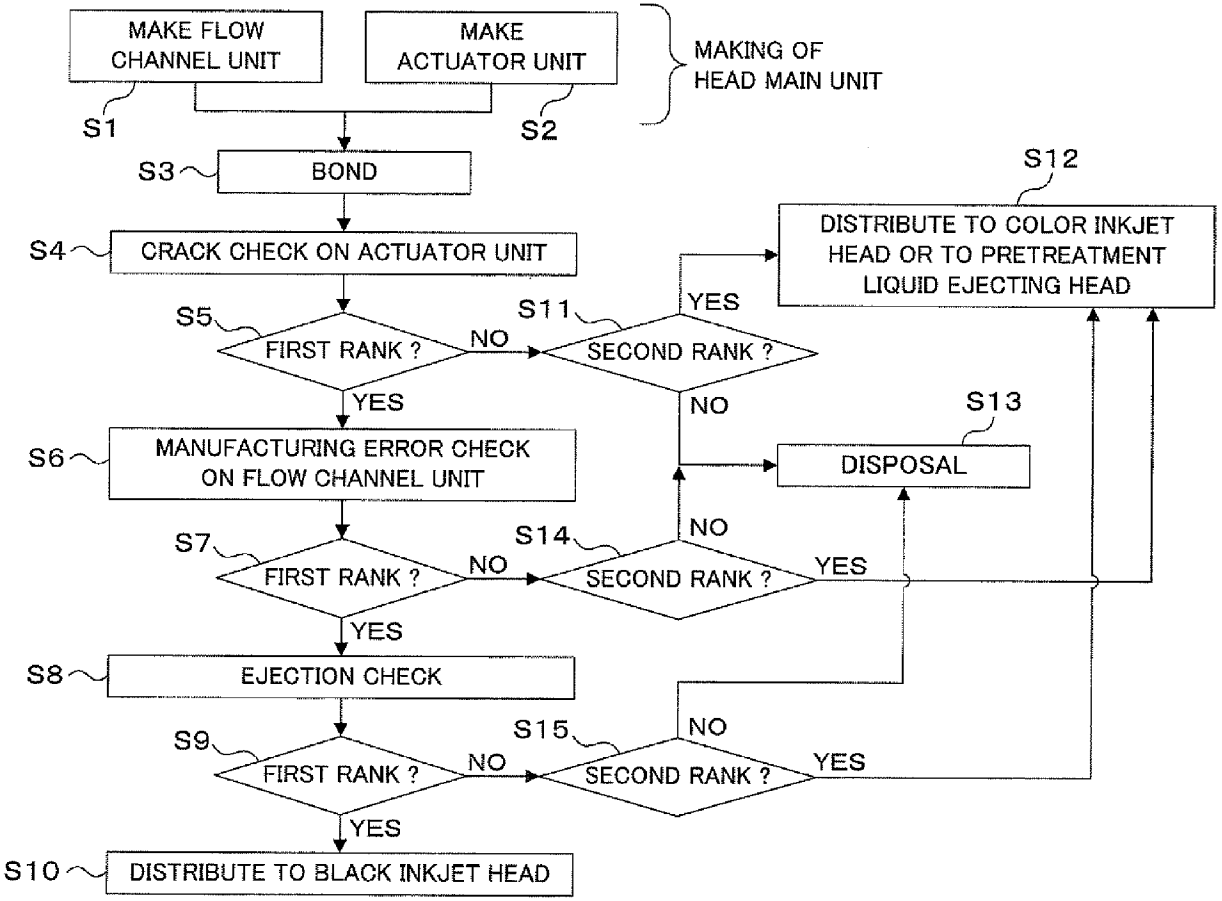
FIG. 6 is a flowchart showing a method for manufacturing the printer.

Next, referring to FIG. 6, a method for manufacturing the printer 101 will be described.

First, the head main unit 2 is made.

Specifically, the making of the flow channel unit 9 (S1) and the making of the actuator units 21 (S2) are individually performed, and four actuator units 21 are bonded to the flow channel unit 9 (S3).

At S1, nine metal plates constituting the flow channel unit 9 are prepared, and grooves and through holes are formed on each metal plate by etching or the like. Then, a thermosetting adhesive is applied to the metal plates. The metal plates are laminated while being aligned with each other and undergo heating and pressurization process, thereby completing the flow channel unit 9.

At S2, first, three green sheets serving as the trapezoidal piezoelectric layers 141 to 143 are prepared. Then, an Ag—Pd conductive paste is screen-printed in the pattern of the plurality of individual electrodes 135 onto the green sheet serving as the piezoelectric layer 141 and in the pattern of the common electrode 134 onto the green sheet serving as the piezoelectric layer 142. Thereafter, while position adjustment is performed by using a jig, on the green sheet serving as the piezoelectric layer 143 where no printing is performed, the green sheet serving as the piezoelectric layer 142 is placed so that the surface where the common electrode 134 is printed faces upward, and further thereon, the green sheet serving as the piezoelectric layer 141 is placed so that the surface where the individual electrodes 135 are printed faces upward. Then, the lamination of the three sheets is defatted similarly to known ceramics, and calcined at a predetermined temperature (calcining process). Thereby, the three sheets serve as the piezoelectric layers 141 to 143, and the conductive paste serves as the individual electrodes 135 and the common electrode 134. Further, using a patterned mask, the conductive lands 136 are printed onto the individual electrodes 135.

At S3, the four actuator units 21 made at step S2 are bonded to the upper surface 9*a* of the flow channel unit 9 made at step S1 (bonding process). At this time, by performing heating and pressurization with an epoxy thermosetting adhesive interposed between the flow channel unit 9 and the actuator units 21, the flow channel unit 9 and the actuator units 21 are fixed together. Moreover, at this time, as shown in FIG. 5B, position adjustment is performed so that the main parts of the individual electrodes 135 overlap the pressure chambers 110 in a plan view. At this time, the openings of the pressure chambers 110 are sealed by the piezoelectric layer 143 of the actuator unit 21.

After S3 (that is, after the head main unit 2 is made), a crack check on the actuator units 21 is performed (S4).

Now cracks formed in the actuator units 21 will be described.

On the actuator units 21, cracks are sometimes caused in the calcining process at S2 and in the bonding process at S3. Cracks are divided into the following four kinds: a through crack; a lower crack; an upper crack; and a fine crack.

The through crack is a crack passing through all the piezoelectric layers 141 to 143 in the vertical direction. The lower crack is a crack passing through the lower piezoelectric layers 142 and 143 and not passing through the uppermost piezoelectric layer 141. The upper crack is a crack passing through the uppermost piezoelectric layer 141 and not passing through the lower piezoelectric cracks 142 and 143. The fine crack is a crack other than the through crack, the lower crack and the upper crack that is comparatively small in depth.

At S4, first, a check liquid (a liquid where pigment components are removed from an ink, or the like) is introduced into the flow channel unit 9 by the pressure of a pump, and all the individual flow channels 132 of the flow channel unit 9 are filled with the check liquid (see FIGS. 7A to 7C).

When the pressure chambers 110 are filled with the check liquid, at cracks exposed to the check liquid, the check liquid behaves so as to permeate into the cracks due to a capillary phenomenon. At this time, as shown in FIG. 7A, the end portion of a lower crack 151 does not communicate with the atmosphere, and the check liquid does not permeate into the lower crack 151. The end portion of a through crack 152 communicates with the atmosphere as shown in FIG. 7B, so that the check liquid behaves so as to permeate into the crack. When there are no cracks in the actuator units 21, the permeation of the check liquid does not occur as shown in FIG. 7C.

Thereafter, an electric field is applied between the common electrode 134 and the flow channel unit 9 (see FIGS. 8A and 8B: for example, a high voltage of +5 V to the flow channel unit 9 and the ground potential to the common electrode 134), and the resistance value therebetween (first resistance value) is measured under the condition where the electric field is applied.

Figure 8A:
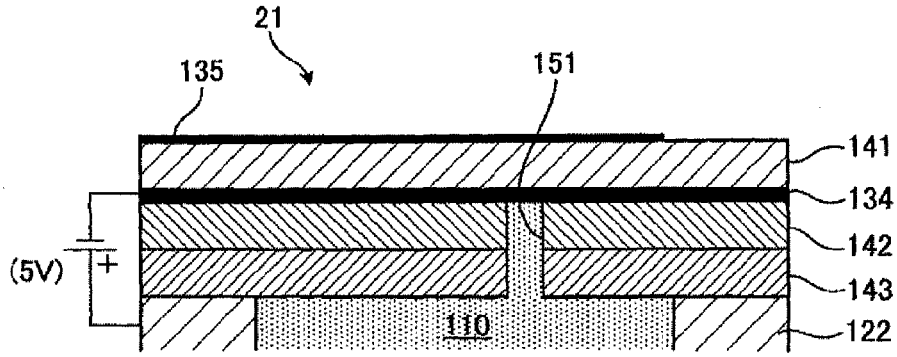
FIG. 8A is a schematic sectional view showing a condition where when a lower crack is formed in the actuator unit, an electric field is applied between a common electrode and the flow channel unit of the actuator unit in the crack check on the actuator unit.
Figure 8B:
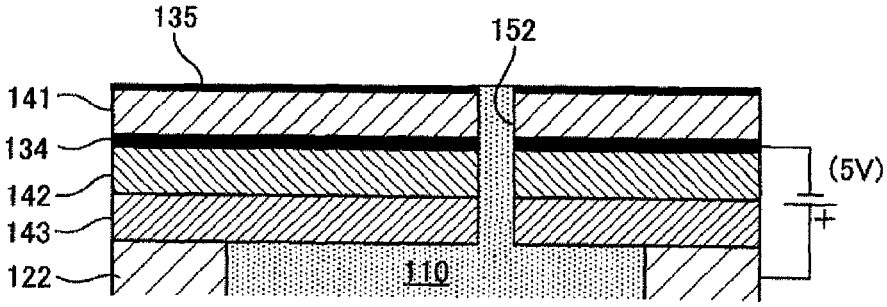
FIG. 8B is a schematic sectional view showing a condition where when a through crack is formed, the electric field is applied between the common electrode and the flow channel unit of the actuator unit in the crack check on the actuator unit.

By the application of the electric field, electroendosmosis involved in the electrolysis of the check liquid occurs at the cracks exposed to the check liquid. At the lower crack 151, as shown in FIG. 8A, the check liquid reaches the common electrode 134. At the through crack 152, as shown in FIG. 8B, the check liquid also reaches at least the common electrode 134 (FIG. 8B shows a condition where the check liquid reaches the upper surface of the piezoelectric layer 141). In any case, the flow channel unit 9 and the common electrode 134 are electrically connected, so that the first resistance value is extremely low. On the other hand, when neither the lower crack 151 nor the through crack 152 is formed, the flow channel unit 9 and the common electrode 134 are not electrically connected, so that the first resistance value is extremely high. Thus, the presence or absence of the through crack 152 and the lower crack 151 can be determined based on the first resistance value. In this description, when the first resistance value is lower than 500 MΩ (megohms) (first threshold value), it is determined that the lower crack 151 or the through crack 152 is formed.

At this time, the presence of just one actuator unit 21 having the lower crack 151 or the through crack 152 formed therein among the four actuator units 21 of one head main unit 2 makes the first resistance value extremely low.

The value of the voltage applied therebetween may be determined so that it is higher than the lowest voltage at which the check liquid in the pressure chamber 110 goes up in the lower crack. 151 to reach the common electrode 134 and is lower than a voltage at which delamination between the piezoelectric layers 142 and 143 is caused by the hydrogen generated by the electrolysis. Since whether delamination occurs or not depends not only on the value of the voltage but also on the voltage application time, when the value of the voltage is high, it is effective that the voltage application time is short.

Thereafter, the electric field with the flow channel unit 9 at the high voltage is canceled, an electric field in a direction opposite to that in the previous electric field application is applied between the common electrode 134 and the flow channel unit 9 (see FIGS. 9A and 9B: for example, the ground potential to the flow channel unit 9, and a high voltage of +1 V to the common electrode 134), and the resistance value therebetween (second resistance value) is measured under the condition where the electric field is applied. At this time, hardly any electroendosmosis of the check liquid into a crack occurs due to this electric field.

Figure 9A:
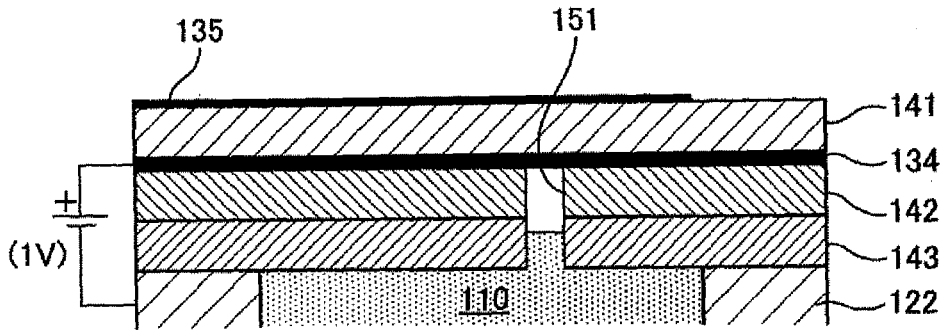
FIG. 9A is a schematic sectional view showing a condition where when a lower crack is formed in the actuator unit, an electric field in a direction opposite to that in FIG. 8A is applied between the common electrode and the flow channel unit of the actuator unit in the crack check on the actuator unit.
Figure 9B:
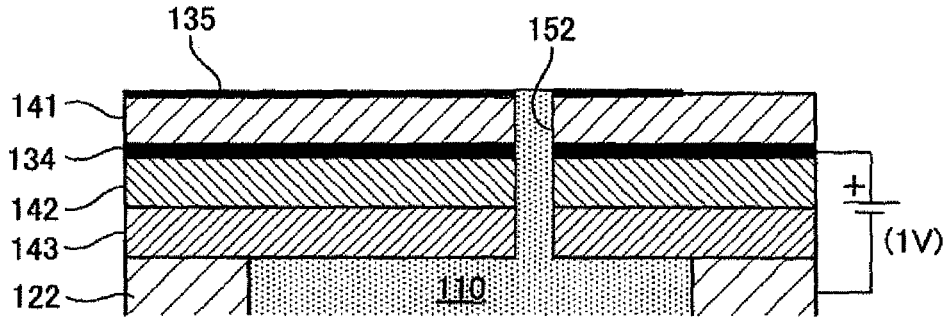
FIG. 9B is a schematic sectional view showing a condition where when a through crack is formed, the electric field in the direction opposite to that in FIG. 8B is applied between the common electrode and the flow channel unit of the actuator unit in the crack check on the actuator unit.

At the lower crack 151, as shown in FIG. 9A, the check liquid is separated from the common electrode 134. In this case, the second resistance value is comparatively high. At the through crack 152, as shown in FIG. 9B, the check liquid hardly moves and is situated above the common electrode 134. In this case, the second resistance value is extremely low. Thus, whether the crack is the lower crack 151 or the through crack 152 can be determined based on the second resistance value.

After the second resistance value is measured, the application of the electric field therebetween is canceled.

After S4, the head main unit 2 is ranked based on the result of the check at S4.

In the present embodiment, the head main unit 2 is classified as one of the first rank, the second rank and the third rank based on is the first threshold value associated with the first resistance value and a second threshold value (for example, 300 MΩ [megohms]) associated with the second resistance value. When the first resistance value is equal to or higher than the first threshold value, the head main unit 2 is classified as the first rank. In the head main unit 2 that falls under the first rank, neither the through crack 152 nor the lower crack 151 is formed in any of the actuator units 21. When the first resistance value is lower than the first threshold value and the second resistance value is equal to or higher than the second threshold value, the head main unit 2 is classified, as the second rank. The head main unit 2 that falls under the second rank does not include an actuator unit 21 having the through crack 152 formed therein, and includes an actuator unit 21 having the lower crack 151 formed therein. When the first resistance value is lower than the first threshold value and the second resistance value is lower than the second threshold value, the head main unit 2 is classified, as the third rank. The head main unit 2 that falls under the third rank includes an actuator unit 21 having the through crack 152 formed therein.

Based on the result of the check at S4, on the head main unit 2 classified as the first rank (YES at S5), a manufacturing error check on the flow channel unit 9 is further performed (S6). The head main unit 2 classified as the second rank (No at S5 and YES at S11) is distributed to color inkjet heads 1*b* to 1*d* (high brightness heads) or to the pretreatment liquid ejecting head 1*a* (high brightness head) (S12). The head main unit 2 classified as the third rank (No at S5 and NO at S11) is dealt with as a head not applied to the printer 101 (S13).

Here, the cracks formed in the actuator units 21 cause a difference in the liquid ejecting performance of the head main unit 2.

In the actuator unit 21 having the through crack 152 formed therein, since the liquid in the pressure chambers 110 readily permeates into the cracks due to a capillary phenomenon, an electric short readily occurs between the individual electrodes 135 and the common electrode 134. When an electric short occurs, the piezoelectric actuators do not operate normally. The actuator unit 21 having the lower crack 151 formed therein operates normally at this point in time however, if the crack grows into the through crack 152 because of some factor, there is a possibility that the piezoelectric actuators do not operate normally.

In the present embodiment, the upper crack and the fine crack are treated similarly to a case where there are no cracks (that is, the head main unit 2 including actuator units 21 having an upper crack or a fine crack formed therein is classified as the first rank).

At S6, measurement of the size of the ejection outlets 108, measurement of the resistance of the flow channels formed in the flow channel unit 9 and measurement of the resonance frequency of the piezoelectric actuators are performed. As the measurement of the size of the ejection outlets 108, it may be performed to measure the sizes of all or some of the ejection outlets 108 included in the head main unit 2 and calculate the average value thereof. The measurement of the flow channel resistance may be performed, for example, with the check liquid introduced into the flow channel unit 9 by the pressure of a pump.

After S6, the head main unit 2 is ranked based on the result of the check at S6.

For example, the head main unit 2 is classified as the first rank when the above-mentioned three measurement values (the measurement values of the size of the ejection outlet 108, the flow channel resistance and the resonance frequency) are each within a predetermined range, as the second rank when one of the measurement values is outside the predetermined range, and as the third rank when two or more of the measurement values are outside the predetermined range.

On the head main unit 2 classified as the first rank based on the result of the check at S6 (YES at S7), an ejection check is further performed (S8). The head main unit 2 classified as the second rank (No at S7 and YES at S14) is distributed to the color inkjet heads 1*b* to 1*d* or to the pretreatment liquid ejecting head 1*a* (S12). The head main unit 2 classified as the third rank (No at S7 and NO at S14) is dealt with as a head not applied to the printer 101 (S13).

At S8, by ejecting a liquid from the ejection outlet 108 to an object (for example, the sheet P), the liquid ejecting performance is evaluated, based on at least one of the size and the position of the dot formed on the object.

For example, when it is intended to check the shading, a drive signal of a solid pattern is supplied to the actuator unit 21, and when it is intended to check crosstalk (a phenomenon inn which ejection from one ejection outlet 108 affects ejection from another ejection outlet adjoining the ejection outlet 108), a drive signal of a pattern suitable for the crosstalk check is supplied to the actuator unit 21. Then, based on the test image formed on the object, whether a non-ejecting ejection outlet 108 is present or not, the presence or absence of crosstalk and the degree thereof, the shading of the entire image, the presence or absence of a satellite droplet (a liquid droplet that is cut off from the main liquid droplet of the liquid ejected from the ejection outlet 108) and the like are compared with their respective reference values to evaluate the liquid ejecting performance. The evaluation may be visually performed or may be mechanically performed by reading the test image with image reading means such as a scanner.

After S8, the head main unit 2 is ranked based on the result of the check at S8.

The method for ranking at this time is similar to that of the ranking based on the result of the check at S6. For example, the head main unit 2 is classified as the first rank when the size and the position of the dot are within a predetermined range in all the ejection outlets 108 included, in the head main unit 2, as the second rank when one of the size and the position of the dot is outside the predetermined range in at least a part of the ejection outlets 108 included in the head main unit 2, and as the third rank when both the size and the position of the dot are outside the predetermined range in at least a part of the ejection outlets 108 included in the head main unit 2.

In the present embodiment, when the dot size is smaller than a predetermined value (when the amount of liquid ejected from the ejection outlet 108 is smaller than a predetermined amount or when there is a missing dot in the test image because of non-ejection of the ejection outlet 108) or when the error of the dot position from a predetermined position is larger than a predetermined value (when the amount of shift of the liquid ejected from the ejection outlet 108 from a predetermined direction associated with the flying direction is larger than a predetermined amount), it is determined that the liquid ejecting performance is lower than a predetermined performance.

Based on the result of the check at S8, the head main unit 2 classified as the first rank (YES at S9) is distributed to the black inkjet head 1*e* (low brightness head) (S10). The head main unit 2 classified as the second rank (NO at S9 and YES at S15) is distributed to the color inkjet heads 1*b* to 1*d* (high brightness head) or to the pretreatment liquid ejecting head 1*a* (high brightness head) (S12). The head main unit 2 classified as the third rank (NO at S9 and NO at S15) is dealt with as a head not applied to the printer 101 (S13).

A plurality of head main units 2 are made, checks and rankings as described above are performed on each head main unit 2, and five head main units 2 distributed to the heads 1*a* to 1*e*, respectively, are prepared. Then, the COF, the liquid distribution member, the circuit board and the like are fixed to each of the five head main units 2, thereby completing the heads 1*a* to 1*e*.

Thereafter, the heads 1*a* to 1*e* are fixed to the frame 3 and then, assembled to the housing 101*a* together with the frame 3, or the heads 1*a* to 1*e* are assembled to the frame 3 having already been fixed within the housing 101*a*.

Through the processes as described above, the printer 101 is completed.

As described above, according to the method for manufacturing the printer 101 according to the present embodiment, since the lower the brightness of a liquid is, the more the liquid contributes to image quality, the head main unit 2 classified as the first rank is distributed, to the black inkjet head 1*e* and the head main unit 2 classified as the second rank is distributed to the color inkjet heads 1*b* to 1*d* or to the pretreatment liquid ejecting head 1*a* without being disposed of. By thus distributing the heads according to the rank, yield can be improved while the overall liquid ejecting performance of the apparatus is ensured.

The head main units 2 of the third rank (that is, evaluated as inferior in liquid ejecting performance to the second rank) are disposed of without used as heads of the printer 101. By doing this, the overall liquid ejecting performance of the apparatus can be more reliably ensured.

By performing ranking in each check process, the overall liquid ejecting performance of the apparatus can be more reliably ensured.

At S8 (ejection check), by performing the check while actually ejecting a liquid from the head main unit 2, a more effective check result is obtained.

At S6 (manufacturing error check), the check can be performed without a liquid being actually ejected from the head main unit 2. Moreover, evaluation can be accurately performed by numerical values.

At S4 (crack check on the actuator units), the check can be performed without a liquid being actually ejected from the head main unit 2. Moreover, since malfunction of the actuator units 21 can significantly affect the liquid ejecting performance, by performing the check on the actuator units 21 and performing ranking based on the result of the check, the overall liquid ejecting performance of the apparatus can be more reliably ensured.

According to the method for manufacturing the printer 101 according to the present embodiment, no further check nor ranking is performed on the head main unit 2 classified as the second or lower rank based on the result of a check. By doing this, the process is simplified. On the other hand, a further check and ranking are performed on the head main unit 2 classified as the first rank based on the result of a check. By doing this, ranking can be more appropriately performed.

The head 1 is a line type head that is elongated in the main scanning direction and ejects liquid to the sheet P in a fixed state. Therefore, the problem in that the deterioration of the yield is significant particularly in the case of the line type head can be effectively prevented.

Next, referring to FIG. 10, a program executed by the control device 100 of the printer 101 will be described.

Figure 11:
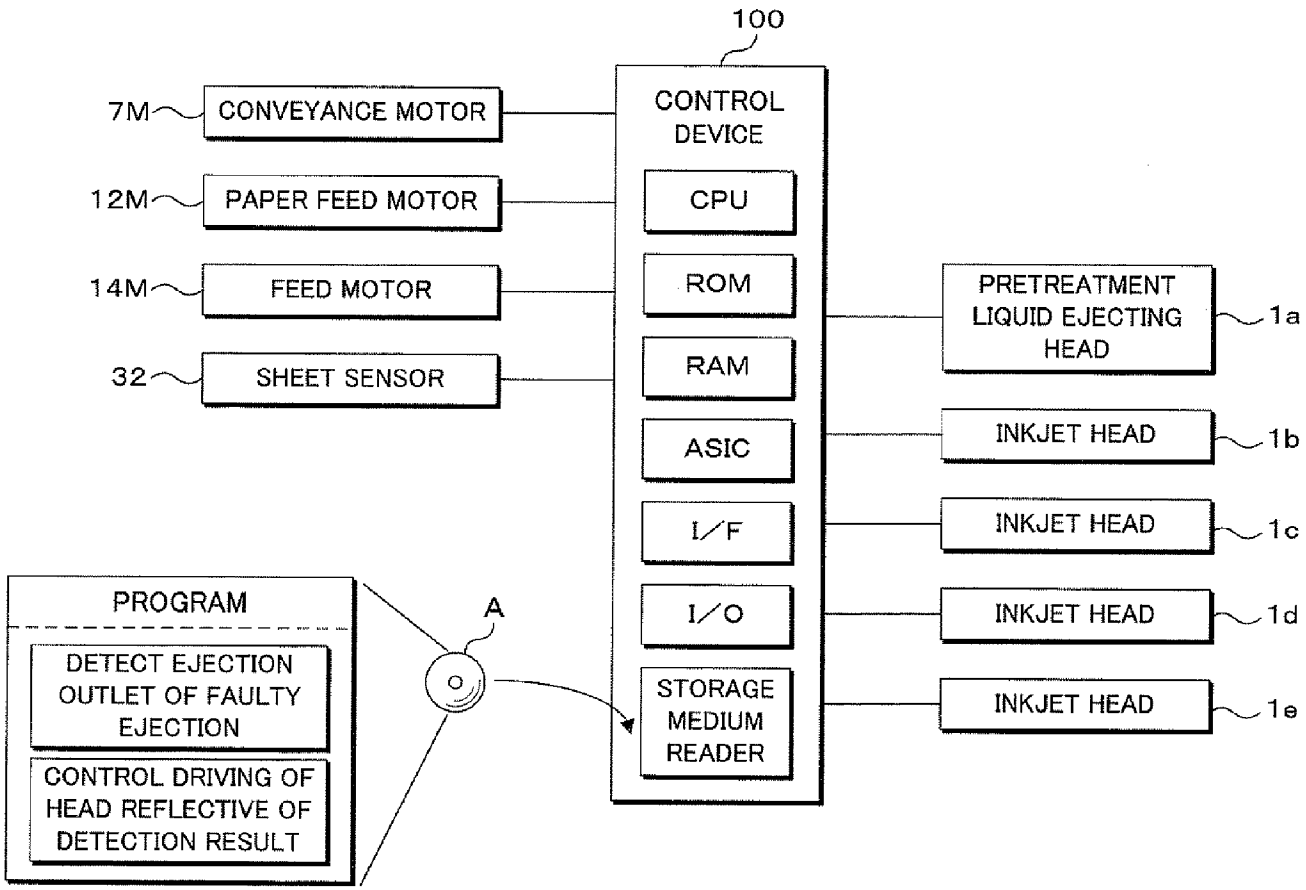
FIG. 11 is a block diagram showing the electric structure of the printer.

The control device 100 includes, as shown in FIG. 11, a ROM (read only memory), a RAM (random access memory, including a nonvolatile RAM), an ASIC (application specific integrated circuit), an I/F (interface) and an I/O (input/output port) in addition to a CPU (central processing unit) as an arithmetic processing unit. The ROM stores programs executed by the CPU, various kinds of fixed data and the like. The RAM temporarily stores data required when programs are executed. At the ASIC, image data rewriting, sorting and the like (for example, signal processing and image processing) are performed. The I/F performs data transmission and reception with an external apparatus (a PC connected to the printer 101, or the like). The I/O performs input and output of detection signals of various sensors.

Figure 10:
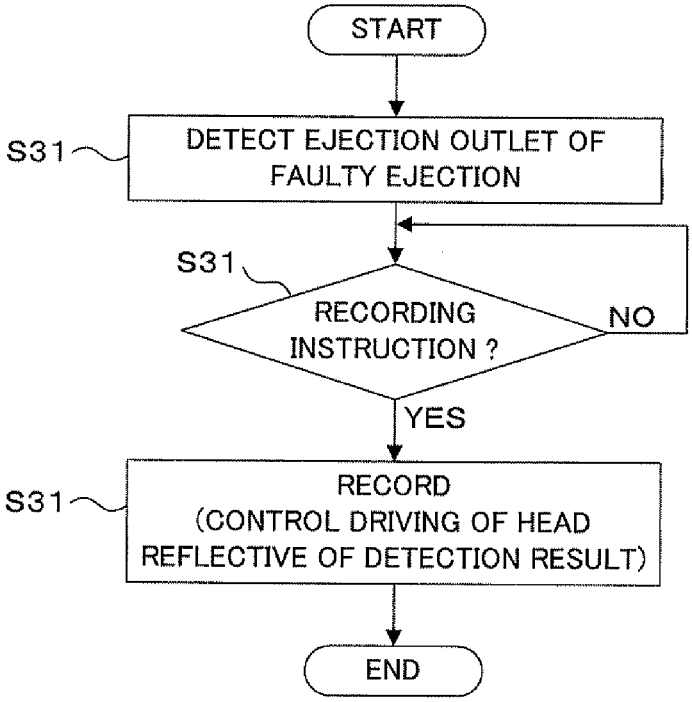
FIG. 10 is a flowchart showing a program executed by a control device of the printer.

The processings of FIG. 10 are executed by the CPU according to the programs stored in the ROM.

When the power of the printer 101 is turned on, the control device 100 first detects an ejection outlet 108 the liquid ejecting performance of which is evaluated as lower than the predetermined performance (faulty ejection) in the pretreatment liquid ejecting head 1*a* and the color inkjet heads 1*b* to 1*d* other than the black inkjet head 1*e* (S31).

At this time, the control device 100 performs this detection based on information prestored in the RAM or based on the result of test recording (after the power-on, a test sheet P is conveyed and ejecting is performed onto the sheet P). To adopt the former, in the manufacturing process of the printer 101, the head 1 classified as the second rank and the position of the ejection outlet 108 of the head 1 the liquid ejecting performance of which is evaluated as lower than the predetermined performance are stored in the RAM.

After S31, the control device 100 determines whether a recording instruction has been received or not (S32).

When no recording instruction has been received (No at S32), the control device 100 repeats this processing. When a recording instruction has been received (YES at S32), the control device 100 controls the driving of the conveyance mechanism 16, the head 1 and the like so that recording associated with the recording instruction is performed (S33). After S33, the control device 100 ends this routine.

At S33, the control device 100 performs driving control of the head 1 reflective of the detection result at S31 as described below.

(1) When the liquid is ejected from the inkjet heads 1*b* to 1*e* in a case where the head main unit 2 of the second rank is distributed to the pretreatment liquid ejecting head 1*a*, the driving of the inkjet heads 1*b* to 1*e* is controlled so that the amount of liquid ejected from, of the ejection outlets of the inkjet heads 1*b* to 1*e*, the ejection outlet corresponding to the ejection outlet of the pretreatment liquid ejecting head 1*a* detected at S31 (in the present embodiment, situated in the same position with respect to the main scanning direction) is larger than a predetermined amount (for example, from the corresponding ejection outlets 108 of the inkjet heads 1*b* to 1*e*, an amount of liquid larger than the amount indicated by the image data [specifically, when the number of droplets constituting one pixel is one, two or three droplets] is ejected).

(2) When the liquid, is ejected from, of the pretreatment liquid ejecting head 1*a* and the color inkjet heads 1*b* to 1*d*, the head 1 having the head main unit 2 of the second rank to the sheet P, the driving of the head 1 is controlled so that the amount of liquid ejected from, of the ejection outlets 108 of the head 1, the ejection outlet adjoining the ejection outlet detected at S31 (that is, evaluated as a faulty ejection) is larger than a predetermined amount (for example, from the corresponding ejection outlets 108 of the pretreatment liquid ejecting head 1*a* and the color inkjet heads 1*b* to 1*d*, an amount of liquid larger than the amount indicated by the image data [specifically, when the number of droplets constituting one pixel is one, two or three droplets] is ejected).

(3) In a case where the ejection outlet detected at S31 is a faulty ejection outlet other than a non-ejecting ejection outlet, when the liquid is ejected from the head 1 to the sheet P, the driving of the head 1 is controlled so that the liquid is not ejected from the ejection outlet detected at S31.

Further, the present invention is structured so that the above-described programs may be provided through a portable storage medium A such as a CD-ROM. The contents thereof will be described below.

The control device 100 of the printer 101 is provided with an exterior (or interior) storage medium reader. Into the storage medium reader, the portable storage medium A is inserted that stores a program to cause the printer 101 to function as the detecting section that detects, of the ejection outlets of the high brightness heads, the ejection outlet the liquid, ejecting performance of which is evaluated lower than the predetermined performance and the first controller that controls the driving of the low brightness head so that when the liquid is ejected from the colorless head and the low brightness head to the recording medium, the amount of liquid ejected from, of the ejection outlets of the low brightness head, the ejection outlet corresponding to the ejection outlet of the colorless head detected by the detecting section is larger than a predetermined amount, and for example, the CPU installs this program into the ROM. Such a program is executed being loaded in the RAM. Thereby, the program functions as the printer 101 of the present invention.

The storage medium may be a so-called program medium, or may be a medium carrying program codes in a fixed manner, such as tapes including a magnetic tape or a cassette tape, disks including magnetic disks such as a flexible disk or a hard disk, or an optical disk such as a CD-ROM, an MO, an MD or a DVD, cards such as an IC card (including a memory card) or an optical card, or semiconductor memories such as a mask ROM, an EPROM, an EEPROM and a flash ROM.

As described above, according to the printer 101, the control device 100 and the program of the present embodiment, in addition to the effects by the above-described manufacturing method (the effect in that both the ensurement of the overall liquid ejecting performance of the apparatus and the improvement in yield are obtained, and so forth), the following effects are obtained:

By the above-described control of (1), the part where the liquid ejecting performance is low in the pretreatment liquid ejecting head 1*a* can be made up for by the ink ejected from the inkjet heads 1*b* to 1*e*. Consequently, image quality can be improved.

By tine above-described control of (2), the part where the liquid ejecting performance is low in the head 1 having the head main unit 2 of the second rank can be made up for by the liquid ejected from surroundings thereof. Consequently, image quality can be improved.

By the above-described control of (3), by ejecting no liquid from the ejection outlet evaluated as a faulty ejection outlet other than a non-ejecting ejection outlet and making up for the part by the liquid ejected from surrounding ejection outlets, image quality degradation can be effectively prevented.

While the preferred embodiment of the present invention has been described above, the present invention is not limited to the above-described embodiment, but various design changes may be made within the description of the claims.

Regarding the liquid ejected by the liquid ejecting heads:

The "predetermined brightness" is a brightness where contribution to image quality is determined to be comparatively small, and may be set as appropriate. The liquid of the brightness lower than the predetermined brightness is not limited to black ink but may be an ink of a different color (cyan, magenta, or the like).

It may be only the color inkjet heads or only the colorless head that the liquid ejecting apparatus comprises as the high brightness head (for example, it may be only the black inkjet head 1*e* and the color inkjet heads 1*b* to 1*d* or only the black inkjet head 1*e* and the pretreatment liquid ejecting head 1*a* that the printer 101 of the above-described embodiment comprises).

The colorless head is not limited to the head that ejects pretreatment liquid, but may be, for example, a head that ejects an aftertreatment liquid (a head that ejects an aftertreatment liquid that exerts an appropriate action on the recording medium after the ink ejected from the inkjet head impinges on the recording medium). In this case, the head that ejects the aftertreatment liquid is disposed on the downstream side of the inkjet heads 1*b* to 1*e* in the conveyance direction.

Regarding the check process:

The check performed in the check process is, in addition to the crack check on the actuator units, the manufacturing error check on the flow channel unit and the ejecting check in the above-described embodiment, arbitrary as long as it is a check associated with the liquid ejecting performance of the ejection outlets.

The number of checks performed in the check process could be one or more and arbitrary (it may be only one kind of check [for example, the ejecting check] that is performed in the check process).

Regarding the deformation element check:

While in the above-described embodiment, the deformation element check (the crack check on the actuator units 21) is performed after the actuator units 21 are bonded to the flow channel unit 9, the check may be performed before the actuator units 21 are bonded to the flow channel unit 9. Moreover, it may be performed to perform the crack check before forming the individual electrodes 135 and the lands 136 and form the individual electrodes 135 and the lands 136 after the check. Moreover, the crack check may be performed after the COF is bonded to the upper surface of each actuator unit 21. Although there is a possibility that a crack is caused when the COF is bonded to the actuator units 21, since the points of junction between the actuator units 21 and the COF are the lands 136 situated away from the pressure chambers 110, the crack hardly reaches the pressure chambers 110.

To detect the upper crack, in addition to the above-described series of processes at S4, an additional process (process in which with a check liquid disposed on the upper surface of the piezoelectric layer 141, a conductive probe for the check is brought into contact with the upper surface, a voltage is applied between the probe and the common electrode 134, and the resistance value [third resistance value] therebetween is detected under a condition where the voltage is applied) may be performed. When the third resistance value is lower than a third threshold value, it is determined that the actuator unit 21 has an upper crack. In this case, the head main unit 2 may be classified as the second rank.

The deformation element includes, in addition to the piezoelectric element, an electrostatic element, a resistance heating element and the like.

Regarding the manufacturing error check:

While the manufacturing error of the flow channel unit 9 is checked in the above-described embodiment, in addition thereto, the manufacturing error of the liquid distribution member may be checked.

In the manufacturing error check, the size of a given part constituting the flow channel of the liquid ejecting head may be measured. The measurement of the size may be performed individually on each plate before the making of the flow channel unit 9 is completed (before a plurality of plates constituting the flow channel unit 9 are bonded together).

The deformation element subjected to the manufacturing error check is not limited to the piezoelectric element, but includes the electrostatic element, the resistance heating element and the like.

Regarding the ejecting check:

While in the above-described embodiment, ranking is performed based on the number and disposition of the ejection outlets the liquid ejecting performances of which are determined to be lower than the predetermined performance as a result of the ejecting check, the present invention is not limited thereto, but raking may be performed based on the overall quality of the test image (the presence or absence of shading and nonuniformity).

In the ejecting check, the object to which the liquid is ejected is not specifically limited.

Regarding the ranking process:

The number of ranks is arbitrary as long as it is two or more (for example, classification may be made into two ranks of the first rank and the second rank).

The reference for the ranking may be arbitrarily set (for example, even if some of the ejection outlets included in the head are faulty ejection outlets, when the contribution by the ejection outlets to image quality is comparatively small, the head may be classified as the first rank).

Regarding the check process and the ranking process:

The timing of the check process and the ranking process is arbitrary (the checks may be performed at any time such as before the assembly of the head, after the assembly or in the middle of the assembly). For example, in the above-described embodiment, the check process and the ranking process may be performed under a condition where members such as the COF, the liquid distribution member and the circuit board are fixed to the head main unit 2.

That is, while the object to be checked and ranked is the head main unit 2 in the above-described embodiment, it is arbitrary as long as it is a part that constitutes the liquid ejecting head and contributes to the liquid ejecting performance.

Instead of performing the ranking in each check, it may be performed to perform a plurality of checks (for example, the crack check on the actuator units, the manufacturing error check on the flow channel unit and the ejecting check in the above-described embodiment) and then, perform ranking by comprehensively evaluating the results of the checks.

The check process and the ranking process may be performed either by a person or by an apparatus (for example, the check process and the ranking process may be automatically performed by an apparatus).

Others:

In the manufacturing method for the present invention, the disposal process is not essential.

The liquid ejecting apparatus may include a head manufactured without undergoing the check process or the ranking process.

The above-described control of (1) may be performed on a given head of the plurality of inkjet heads 1*b* to 1*e* (for example, only on the black inkjet head 1*e*, a control to make the amount of liquid ejected from the corresponding ejection outlet larger than a predetermined amount is performed, and on the other inkjet heads 1*b* to 1*d*, such a control is not performed and the normal control is performed).

The present invention is applicable to both the line type and the serial type, and is not limited to printers but is applicable to facsimiles, copiers and the like.

The present invention is also applicable to apparatuses that eject liquids other than ink.

The recording medium is not limited to the sheet P but may be various recordable media (for example, cloth).

As this description may be embodied in several forms without departing from the spirit of essential characteristics thereof, the present embodiment is therefore illustrative and not restrictive, since the scope is defined by the appended claims rather than by the description preceding them, and all changes that fall within metes and hounds of the claims, or equivalence of such metes and bounds thereof are therefore intended to be embraced by the claims.

What is claimed is:

1. A method for manufacturing a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, the method comprising:

a check process of performing a check associated with liquid ejecting performance of the ejection outlet on each of the plurality of liquid ejecting heads;

a ranking process of classifying, based on a result of the check, the plurality of liquid ejecting heads as any of a plurality of ranks including a first rank where the liquid ejecting performance is equal to or higher than a predetermined performance and a second rank where the liquid ejecting performance is lower than the first rank; and a distribution process of distributing the liquid ejecting head classified as the first rank in the ranking process to the low brightness head, and distributing the liquid ejecting head classified as the second rank in the ranking process to the high brightness head.

2. The method for manufacturing the liquid ejecting apparatus according to claim 1, wherein the plurality of ranks include the first rank, the second rank and a third rank where the liquid ejecting performance is lower than the second rank, and the method further comprises a process of dealing with the liquid ejecting head classified as the third rank in the ranking process, as a head not applied to the liquid ejecting apparatus.

3. The method for manufacturing the liquid ejecting apparatus according to claim 1, wherein the plurality of liquid ejecting heads each include a plurality of ejection outlets, and in the ranking process, when the liquid ejecting performance of all the ejection outlets included in the liquid ejecting head is equal to or higher than the predetermined performance, the liquid ejecting head is classified as the first rank, and when the liquid ejecting performance of at least a part of the ejection outlets included in the liquid ejecting head is lower than the predetermined performance, the liquid ejecting head is classified as the second or lower rank.

4. The method for manufacturing the liquid ejecting apparatus according to claim 1, wherein the check includes an ejecting check in which by ejecting a liquid from the ejection outlet to an object, the liquid ejecting performance is evaluated based on at least one of a size and a position of a dot formed on the object.

5. The method for manufacturing the liquid ejecting apparatus according to claim 1, wherein the check includes a manufacturing error check in which a manufacturing error of the flow channel is checked.

6. The method for manufacturing the liquid ejecting apparatus according to claim 1, wherein the liquid ejecting heads each include a deformation element that provides the liquid in the flow channel with an energy for ejection from the ejection outlet by changing a volumetric capacity of the flow channel by deforming the flow channel, and the check includes a deformation element check in which the deformation element is checked.

7. The method for manufacturing the liquid ejecting apparatus according to claim 6, wherein the check includes a plurality of checks including the deformation element check, a manufacturing error check in which a manufacturing error of the flow channel is checked and an ejecting check in which by ejecting a liquid from the ejection outlet to an object, the liquid ejecting performance is evaluated based on at least one of a size and a position of a dot formed on the object, in each check, the check process and the ranking process are performed, on the liquid ejecting head classified as the second or lower rank in the ranking process associated with the previously performed check, the check process and the ranking process associated with the remaining check are not performed, and on the liquid ejecting head classified as the first rank in the ranking process associated with the previously performed check, the check process and the ranking process associated with the remaining check are performed.

8. The method for manufacturing the liquid ejecting apparatus according to claim 1, wherein the liquid of the brightness lower than the predetermined brightness is black ink, and the liquid of the brightness equal to or higher than the predetermined brightness includes a color ink and a treatment liquid.

9. The method for manufacturing the liquid ejecting apparatus according to claim 1, wherein the plurality of liquid ejecting heads is arranged in one direction, lengths of the liquid ejecting heads in a direction orthogonal to the one direction are larger than lengths thereof in the one direction, and the liquid ejecting heads are each a line type head that ejects a liquid to a recording medium in a fixed state.

10. A liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, wherein the high brightness head is a colorless head that ejects the colorless liquid, the colorless head and the low brightness head each include a plurality of ejection outlets, and the liquid ejecting apparatus further comprises:

a detecting section that detects, of the ejection outlets of the colorless head, an ejection outlet the liquid ejecting performance of which is evaluated as lower than the predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

11. The liquid ejecting apparatus according to claim 10, further comprising a second controller that controls driving of the colorless head so that when the liquid is ejected from the colorless head to the recording medium, an amount of liquid ejected from, of the ejection outlets of the colorless head, the ejection outlet adjoining the ejection outlet detected by the detecting section is larger than a predetermined amount.

12. The liquid ejecting apparatus according to claim 10, further comprising a third controller that controls driving of the colorless head so that when the ejection outlet detected by the detecting section is a faulty ejection outlet other than a non-ejecting ejection outlet, the liquid is not ejected from the ejection outlet detected by the detecting section when the liquid is ejected from the colorless head to the recording medium.

13. A control device used for a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, and the high brightness head being a colorless head that ejects the colorless liquid, wherein the colorless head and the low brightness head each include a plurality of ejection outlets, and the control device comprises:

a detecting section that detects, of the ejection outlets of the colorless head, an ejection outlet a liquid ejecting performance of which is evaluated as lower than a predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

14. A non-transitory storage medium storing so as to be readable by a computer a program causing a liquid ejecting apparatus comprising a plurality of liquid ejecting heads where an ejection outlet that ejects a liquid and a flow channel extending to the ejection outlet are formed, respectively, the plurality of liquid ejecting heads including a low brightness head that ejects a liquid of a brightness lower than a predetermined brightness and a high brightness head that ejects a liquid of a brightness equal to or higher than the predetermined brightness including a colorless liquid, wherein the high brightness head is a colorless head that ejects the colorless liquid, the colorless head and the low brightness head each include a plurality of ejection outlets, to function as:

a detecting section that detects, of the ejection outlets of the colorless head, an ejection outlet a liquid ejecting performance of which is evaluated as lower than a predetermined performance; and a first controller that controls driving of the low brightness head so that when the liquid is ejected from the colorless head and the low brightness head to a recording medium, an amount of liquid ejected from, of the ejection outlets of the low brightness head, the ejection outlet corresponding to the ejection outlet of the colorless head detected by the detecting section is larger than a predetermined amount.

* * * * *